US011814942B2

(12) United States Patent
Jeffryes et al.

(10) Patent No.: US 11,814,942 B2
(45) Date of Patent: Nov. 14, 2023

(54) OPTIMIZING ALGORITHM FOR CONTROLLING DRILL STRING DRIVER

(71) Applicant: Schlumberger Technology Corporation, Sugar Land, TX (US)

(72) Inventors: Benjamin Peter Jeffryes, Histon (GB); Nathaniel Wicks, Somerville, MA (US); Jian Wu, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 58 days.

(21) Appl. No.: 17/088,735

(22) Filed: Nov. 4, 2020

(65) Prior Publication Data

US 2021/0131259 A1 May 6, 2021

Related U.S. Application Data

(60) Provisional application No. 62/930,045, filed on Nov. 4, 2019.

(51) Int. Cl.
*E21B 44/04* (2006.01)
*E21B 44/08* (2006.01)

(52) U.S. Cl.
CPC ..... *E21B 44/04* (2013.01); *E21B 44/08* (2013.01)

(58) Field of Classification Search
CPC ..... E21B 44/02; E21B 44/04; E21B 44/08
See application file for complete search history.

(56) References Cited

U.S. PATENT DOCUMENTS

| | | | | |
|---|---|---|---|---|
| 8,689,906 | B2 * | 4/2014 | Nessjoen | E21B 44/00 700/20 |
| 9,581,008 | B2 * | 2/2017 | Kyllingstad | E21B 41/0092 |
| 9,689,250 | B2 * | 6/2017 | Badkoubeh | E21B 3/035 |
| 9,885,231 | B2 * | 2/2018 | Nessjoen | G05B 15/02 |
| 9,920,612 | B2 | 3/2018 | Dwars et al. | |
| 9,932,811 | B2 | 4/2018 | Dwars et al. | |
| 10,458,223 | B2 * | 10/2019 | Badkoubeh | E21B 44/04 |
| 10,895,142 | B2 | 1/2021 | Jeffryes et al. | |

(Continued)

OTHER PUBLICATIONS

Dwars, S., "Recent Advances in Soft Torque Rotary Systems", SPE-173037 presented at the SPE/IADC Drilling Conference and Exhibition, London, England, UK, 2015, pp. 12 pages.

(Continued)

*Primary Examiner* — Frederick L Lagman
(74) *Attorney, Agent, or Firm* — Brian J. Pangrle

(57) ABSTRACT

Apparatus and methods for optimizing a stick-slip algorithm for controlling a driver of a drill string. A method may include commencing operation of a control system for controlling the driver. The control system may have a processor and a memory storing a computer program code, which may include the stick-slip algorithm. The operating control system may receive a plurality of different numerical parameters, and for each of the different numerical parameters, incorporate the numerical parameter into the stick-slip algorithm and execute the stick-slip algorithm to determine a control command that causes the driver to rotate the drill string to perform drilling operations while reducing amplitude of rotational waves travelling along the drill string.

19 Claims, 4 Drawing Sheets

(56) References Cited

U.S. PATENT DOCUMENTS

| | | | | |
|---|---|---|---|---|
| 2014/0360779 | A1* | 12/2014 | Kyllingstad | E21B 44/00 175/24 |
| 2016/0047219 | A1 | 2/2016 | Jeffryes | |
| 2016/0076354 | A1* | 3/2016 | Lai | G01L 3/1457 702/9 |
| 2016/0138382 | A1* | 5/2016 | Badkoubeh | E21B 44/00 175/24 |
| 2018/0128093 | A1* | 5/2018 | Jeffryes | E21B 45/00 |
| 2018/0274352 | A1* | 9/2018 | Orban | E21B 44/04 |
| 2019/0106979 | A1* | 4/2019 | Hadi | E21B 44/04 |
| 2019/0234208 | A1* | 8/2019 | Orban | E21B 47/12 |
| 2019/0257153 | A1* | 8/2019 | Badkoubeh | G05D 19/02 |
| 2020/0199994 | A1 | 6/2020 | Jeffryes et al. | |
| 2021/0062636 | A1 | 3/2021 | Jeffryes et al. | |

OTHER PUBLICATIONS

Kyllingstad, A. et al., "A New Stick-Slip Prevention System", SPE-119660 presented at the SPE/IADC Drilling Conference and Exhibition, Amsterdam, The Netherlands, 2009, pp. 14 pages.

Kyllingstad, A. , "A comparison of Stick-Slip Mitigation Tools", SPE-184658, presented at the SPE/IADC Drilling Conference and Exhibition, the Hague, The Netherlands, 2017, pp. 16 pages.

Halsey, G. W. et al., "Torque Feedback Used to Cure Slip-Stick Motion", SPE-18049 presented at the SPE Annual Technical Conference and Exhibition, Houston, Texas, U.S.A., 1988, pp. 277-282.

* cited by examiner

300

| 302 NUMERICAL PARAMETER SET | 304 AVERAGE SURFACE TORQUE FLUCTUATION (%) (STICK-SLIP ALGORITHM OFF) | 306 AVERAGE SURFACE TORQUE FLUCTUATION (%) (STICK-SLIP ALGORITHM ON) | 308 SURFACE TORQUE FLUCTUATION REDUCTION (%) | 310 AVERAGE DOWNHOLE ROTATIONAL SPEED FLUCTUATION (%) (STICK-SLIP ALGORITHM OFF) | 312 AVERAGE DOWNHOLE ROTATIONAL SPEED FLUCTUATION (%) (STICK-SLIP ALGORITHM ON) | 314 DOWNHOLE ROTATIONAL SPEED FLUCTUATION REDUCTION (%) |
|---|---|---|---|---|---|---|
| SET 1 | 26.45 | 8.28 | 68.93 | 331.43 | 58.07 | 82.50 |
| SET 2 | 27.88 | 13.96 | 49.48 | 364.19 | 94.11 | 73.30 |
| SET 3 | 25.51 | 9.98 | 58.11 | 307.19 | 72.33 | 75.27 |
| SET 4 | 28.08 | 10.16 | 63.33 | 338.15 | 76.81 | 77.22 |
| SET 5 | 27.37 | 9.38 | 65.46 | 328.24 | 65.51 | 79.85 |
| SET 6 | 26.82 | 5.71 | 78.61 | 331.62 | 45.98 | 86.14 |

*FIG. 3*

OPTIMIZING ALGORITHM FOR CONTROLLING DRILL STRING DRIVER

CROSS-REFERENCE TO RELATED APPLICATIONS

This application claims priority to and the benefit of U.S. Provisional Application No. 62/930,045, titled "Optimizing Algorithm for Controlling Drill String Driver," filed Nov. 4, 2019, the entire disclosure of which is hereby incorporated herein by reference.

BACKGROUND OF THE DISCLOSURE

Wells are generally drilled into the ground or ocean bed to recover natural deposits of oil, gas, and other materials that are trapped in subterranean formations. Drilling operations may be performed at a wellsite by a well construction system (i.e., a drilling rig) having various surface and subterranean well construction equipment being operated in a coordinated manner. For example, a driver (i.e., a drive mechanism), such as a top drive or a rotary table located at a wellsite surface, can be utilized to rotate and advance a drill string into a subterranean formation to drill a wellbore. The drill string may include a plurality of drill pipes coupled together and terminating with a drill bit. Length of the drill string may be increased by adding additional drill pipes while depth of the wellbore increases.

During drilling operations, a drill string undergoes complicated dynamic behavior, including experiencing axial, lateral, and rotational vibrations, as well as frictional interactions with the bottom and sidewalls of the wellbore being drilled. Rotational speed (i.e., angular velocity) measurements of the drill string taken at the wellsite surface (e.g., at the driver) and downhole (e.g., at the drill bit) have revealed that while the upper end of the drill string rotates with a substantially constant rotational speed, lower portions of the drill string often rotate with varying rotational speeds. For example, a drill string may experience stick-slip motion, whereby a drill bit stops rotating (i.e., sticks) in a wellbore, such as due to friction, while the upper end of the drill string continues to be rotated by the driver, twisting the drill string. When the drill bit becomes free and rotates again (i.e., slips), it accelerates to a rotational speed that may be higher than the rotational speed of the upper end of the drill string.

Such stick-slip motion may cause rotational (i.e., torsional) waves (i.e., oscillations, vibrations, etc.) that propagate or otherwise travel in an upward (i.e., uphole) and/or downward (i.e., downhole) directions along a drill string while the drill string is rotated within a wellbore. Stick-slip motion and the resulting rotational waves in the drill string are a recognized problem in the drilling industry, causing one or more of reduced rate of penetration through the subterranean formation, bit wear, torsional damage to the drill string, failures or damage to the surface driver, and other damage to drilling equipment.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a control system that controls a driver for rotating a drill string. The control system includes a processor and a memory storing a computer program code. The computer program code includes a stick-slip algorithm. The control system receives different numerical parameters and, for each of the different numerical parameters, incorporates the numerical parameter into the stick-slip algorithm and executes the stick-slip algorithm to determine a control command that causes the driver to rotate the drill string to perform drilling operations while reducing rotational waves travelling along the drill string.

The present disclosure also introduces a method that includes commencing operation of a control system for controlling a driver of a drill string. The control system includes a processor and a memory storing a computer program code. The computer program code includes a stick-slip algorithm. The operating control system receives different numerical parameters and, for each of the different numerical parameters, incorporates the numerical parameter into the stick-slip algorithm and executes the stick-slip algorithm to determine a control command that causes the driver to rotate the drill string to perform drilling operations while reducing rotational waves travelling along the drill string.

The present disclosure also introduces a method that includes commencing operation of a processing device to run a computer simulation of a drill string being rotated by a driver to drill a wellbore. Rotation of the driver is controlled by a stick-slip algorithm. The operating processing device receives different numerical parameters and, for each of the different numerical parameters, incorporates the numerical parameter into the stick-slip algorithm and executes the stick-slip algorithm to determine a control command that causes the driver to rotate the drill string to perform drilling operations while reducing amplitude of rotational waves travelling along the drill string.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 3 is a table related to one or more aspects of the present disclosure.

DETAILED DESCRIPTION

Figure 1:
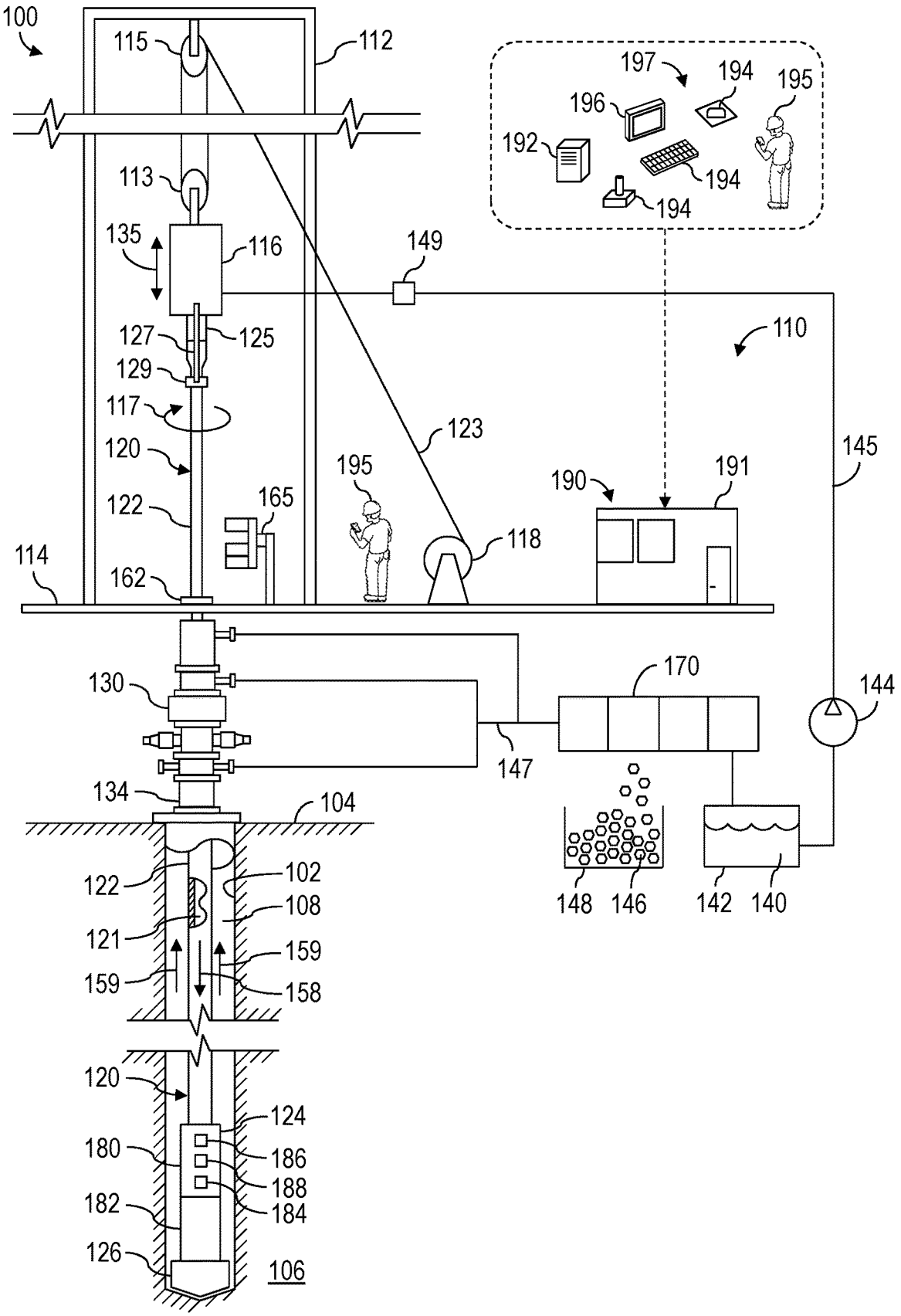
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

Systems and methods (e.g., processes, operations, etc.) according to one or more aspects of the present disclosure may be used or performed in association with a well construction system at a wellsite, such as for constructing a wellbore to obtain hydrocarbons (e.g., oil and/or gas) or other natural resources from a subterranean formation. A person having ordinary skill in the art will readily understand that one or more aspects of systems and methods disclosed herein may be utilized in other industries and/or in association with other systems.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction rig (i.e., a drilling rig). Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean rock formation 106. The well construction system 100 comprises well construction equipment, such as surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown). Certain pieces of surface equipment 110 may be manually operated (i.e., by hand or via a local control panel) by rig personnel 195 (e.g., a roughneck or another human rig operator) located at various portions (e.g., rig floor 114) of the well construction system 100.

The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated by a driver at the wellsite surface 104 and/or via a downhole mud motor 182 connected with the drill bit 126. The BHA 124 may also include one or more downhole tools 180 above and/or below the mud motor 182.

The downhole tools 180 may be or comprise a measurement-while-drilling (MWD) or logging-while-drilling (LWD) tool comprising downhole sensors 184 operable for the acquisition of measurement data pertaining to the BHA 124, the wellbore 102, and/or the rock formation 106. The downhole sensors 184 may comprise an inclination sensor, a rotational position sensor, and/or a rotational speed sensor, which may include one or more accelerometers, magnetometers, gyroscopic sensors (e.g., micro-electro-mechanical system (MEMS) gyros), and/or other sensors for determining the orientation, position, and/or speed of one or more portions of the BHA 124 (e.g., the drill bit 126, the downhole tool 180, and/or the mud motor 182) and/or other portions of the tool string 120 relative to the wellbore 102 and/or the wellsite surface 104. The downhole sensors 184 may comprise a depth correlation tool utilized to determine and/or log position (i.e., depth) of one or more portions of the BHA 124 and/or other portions of the tool string 120 within the wellbore 102 and/or with respect to the wellsite surface 104.

One or more of the downhole tools 180 and/or another portion of the BHA 124 may also comprise a telemetry device 186 operable to communicate with the surface equipment 110 via downhole telemetry, such as mud-pulse telemetry and/or electro-magnetic telemetry. One or more of the downhole tools 180 and/or another portion of the BHA 124 may also comprise a downhole control device 188 (i.e., a processing device) operable to receive, process, and/or store data received from the surface equipment 110, the downhole sensors 184, and/or other portions of the BHA 124. The control device 188 may also store executable computer program code instructions, including for implementing one or more aspects of the operations described herein.

The support structure 112 may support the driver, such as a top drive 116, operable to connect with an upper end of the drill string 120, and to impart rotary motion 117 and vertical motion 135 to the drill string 120, including the drill bit 126. However, another driver, such as a kelly and a rotary table (neither own), may be utilized in addition to or instead of the top drive 116 to impart the rotary motion 117 and vertical motion 135 to the drill string 120. The top drive 116 and the connected drill string 120 may be suspended from the support structure 112 via a hoisting system or equipment, which may include a traveling block 113, a crown block 115, and a drawworks 118 storing a support cable or line 123. The crown block 115 may be connected to or otherwise supported by the support structure 112, and the traveling block 113 may be coupled with the top drive 116. The drawworks 118 may be mounted on or otherwise supported by the rig floor 114. The crown block 115 and traveling block 113 comprise pulleys or sheaves around which the support line 123 is reeved to operatively connect the crown block 115, the traveling block 113, and the drawworks 118 (and perhaps an anchor). The drawworks 118 may thus selectively impart tension to the support line 123 to lift and lower the top drive 116, resulting in the vertical motion 135. The drawworks 118 may comprise a drum, a base, and a motor (e.g., an electric motor) (not shown) operable to drive the drum to rotate and reel in the support line 123, causing the traveling block 113 and the top drive 116 to move upward. The drawworks 118 may be further operable to reel out the support line 123 via a controlled rotation of the drum, causing the traveling block 113 and the top drive 116 to move downward.

The top drive 116 may comprise a grabber, a swivel (neither shown), elevator links 127 terminating with an elevator 129, and a drive shaft 125 operatively connected with a motor (e.g., an electric motor) (not shown) of the top drive 116. The drive shaft 125 may be selectively coupled with the upper end of the drill string 120 and the top drive 116 may be selectively operated to rotate the drive shaft 125 and the drill string 120 coupled with the drive shaft 125. Hence, during drilling operations, the top drive 116, in conjunction with operation of the drawworks 118, may advance the drill string 120 into the formation 106 to form the wellbore 102. The elevator links 127 and the elevator 129 of the top drive 116 may handle tubulars (e.g., drill pipes, drill collars, casing joints, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding the drilling fluid 140 (i.e., drilling mud), and one or more pumps 144 operable to move the drilling fluid 140 from the container 142 into the fluid passage 121 of the drill string 120 via a fluid conduit 145 (e.g., a stand pipe) extending from the pump 144 to the top drive 116 and an internal passage extending through the top drive 116.

During drilling operations, the drilling fluid may continue to flow downhole through the internal passage 121 of the drill string 120, as indicated by directional arrow 158. The drilling fluid may exit the BHA 124 via ports in the drill bit 126 and then circulate uphole through an annular space 108 of the wellbore 102 defined between an exterior of the drill string 120 and the sidewall of the wellbore 102, such flow being indicated by directional arrows 159. In this manner, the drilling fluid lubricates the drill bit 126 and carries formation cuttings uphole to the wellsite surface 104. The drilling fluid flowing downhole 158 through the internal passage 121 may selectively actuate the mud motor 182 to rotate the drill bit 126 instead of or in addition to the rotation of the drill string 120 via the top drive 116. Accordingly, rotation of the drill bit 126 caused by the top drive 116 and/or mud motor 182 may advance the drill string 120 through the formation 106 to form the wellbore 102.

The well construction system 100 may further include fluid control equipment 130 for maintaining well pressure control and for controlling fluid being discharged from the wellbore 102. The fluid control equipment 130 may be mounted on top of a wellhead 134. The drilling fluid flowing uphole 159 toward the wellsite surface 104 may exit the annulus 108 via one or more instances of the fluid control equipment 130, such as a bell nipple, an RCD, and/or a ported adapter (e.g., a spool, cross adapter, a wing valve, etc.). The drilling fluid may then pass through one or more fluid conduits 147 to drilling fluid reconditioning equipment 170 to be cleaned and reconditioned before returning to the fluid container 142. The drilling fluid reconditioning equipment 170 may also separate drill cuttings 146 from the drilling fluid into a cuttings container 148.

An iron roughneck 165 may be positioned on the rig floor 114 to make up and break out connections between the drill pipes of the drill string 120. A set of slips 162 may be located on the rig floor 114, such as may accommodate therethrough the drill string 120 during tubular make up and break out operations, tubular running operations, and drilling operations. The slips 162 may be in an open position during running and drilling operations to permit advancement of the drill string 120, and in a closed position to clamp the upper end (e.g., uppermost tubular) of the drill string 120 to thereby suspend and prevent advancement of the drill string 120 within the wellbore 102, such as during the make up and break out operations.

The surface equipment 110 of the well construction system 100 may also comprise a control center 190 from which various portions of the well construction system 100, such as a drill string rotation system (e.g., the top drive 116 and/or the rotary table), a hoisting system (e.g., the drawworks 118 and the blocks 113, 115), a tubular handling system (e.g., a catwalk and/or a tubular handling device), a drilling fluid circulation system (e.g., the mud pump 144 and the fluid conduit 145), a drilling fluid cleaning and reconditioning system (e.g., the drilling fluid reconditioning equipment 170 and the containers 142, 148), the well control system (e.g., a BOP stack and/or a choke manifold), and the BHA 124, among other examples, may be monitored and controlled. The control center 190 may be located on the rig floor 114 or another location of the well construction system 100, such as the wellsite surface 104. The control center 190 may comprise a facility 191 (e.g., a room, a cabin, a trailer, etc.) containing a control workstation 197, which may be operated by rig personnel 195 (e.g., a driller or another human rig operator) to monitor and control various wellsite equipment or portions of the well construction system 100. The control workstation 197 may be communicatively connected with a surface control device 192 (e.g., a processing device, an equipment controller, etc.), such as may be operable to receive, process, and output information to monitor operations of and provide control to one or more portions of the well construction system 100. For example, the control device 192 may be communicatively connected with the various surface equipment 110 and downhole equipment 120 equipment described herein, and may be operable to receive signals (e.g., sensor data, sensor measurements, etc.) from and transmit signals (e.g., control data, control signals, control commands, etc.) to the equipment to perform various operations described herein. The control device 192 may store executable program code, instructions, and/or operational parameters or set-points, including for implementing one or more aspects of methods and operations described herein. The control device 192 may be located within and/or outside of the facility 191.

The control workstation 197 may be operable for entering or otherwise communicating control commands to the control device 192 by the rig personnel 195, and for displaying or otherwise communicating information from the control device 192 to the rig personnel 195. The control workstation 197 may comprise one or more input devices 194 (e.g., a keyboard, a mouse, a joystick, a touchscreen, etc.) and one or more output devices 196 (e.g., a video monitor, a touchscreen, a printer, audio speakers, etc.). Communication between the control device 192, the input and output devices 194, 196, and the various wellsite equipment 110, 120 may be via wired and/or wireless communication means. However, for clarity and ease of understanding, such communication means are not depicted, and a person having ordinary skill in the art will appreciate that such communication means are within the scope of the present disclosure.

Communication (i.e., telemetry) between the BHA 124 and the controller 192 may be via mud-pulse telemetry (i.e., pressure pulses) sent through the drilling fluid flowing within a fluid passage 121 of the drill string 120. For example, the downhole telemetry device 186 may comprise a modulator selectively operable to modulate the pressure (i.e., cause pressure changes, pulsations, and/or fluctuations) of the drilling fluid flowing within the fluid passage 121 of the downhole tool 180 to transmit downhole data (i.e., downhole measurements) received from the downhole controller 188, the downhole sensors 184, and/or other portions of the BHA 124 in the form of pressure pulses. The modulated pressure pulses travel uphole along the drilling fluid through the fluid passage 121, the top drive 116, and the fluid conduit 145 to be detected by an uphole telemetry device 149. The uphole telemetry device 149 may comprise a pressure transducer or sensor in contact with the drilling fluid being pumped downhole. The uphole telemetry device 149 may thus be disposed along or in connection with the fluid conduit 145, the top drive 116, and/or another conduit or device transferring or in contact with the drilling fluid being pumped downhole. The uphole telemetry device 149 may be operable to detect the modulated pressure pulses, convert the pressure pulses to electrical signals, and communicate the electrical signals to the controller 192. The controller 192 may be operable to interpret the electrical signals to reconstruct the downhole data transmitted by the downhole telemetry device 186.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

Figure 2:
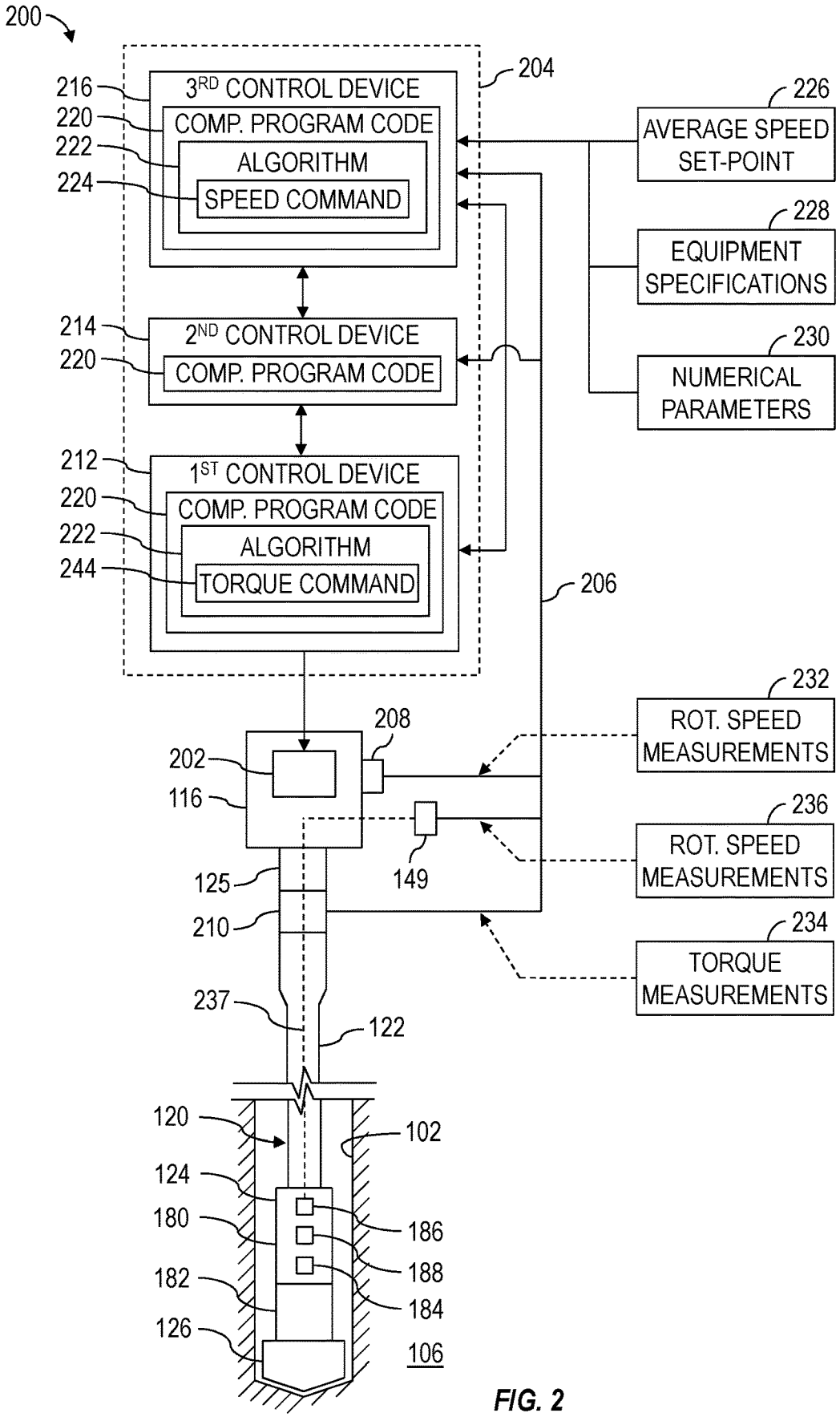
FIG. 2 is a schematic view of at least a portion of an example implementation of apparatus according to one or more aspects of the present disclosure.

FIG. 2 is a schematic view of at least a portion of an example implementation of a control system 200 operable to monitor and control operation of a drill string driver (e.g., a top drive) according to one or more aspects of the present disclosure. The control system 200 may form a portion of or operate in conjunction with the well construction system 100 shown in FIG. 1, and thus may comprise one or more features of the well construction system 100 shown in FIG. 1, including where indicated by the same reference numerals. Accordingly, the following description refers to FIGS. 1 and 2, collectively.

The top drive 116 may comprise an electric motor 202 operatively connected to the drive shaft 125. During drilling operations, the drive shaft 125 may be coupled with the upper end of the drill string 120 operable to drill the wellbore 102. The drill string 120 may comprise the BHA 124 at the lower end thereof. The BHA 124 may comprise the drill bit 126, the mud motor 182 operable to rotate the drill bit 126, and one or more downhole tools 180 above and/or below the mud motor 182.

One or more of the downhole tools 180 may be or comprise a MWD or LWD tool comprising downhole sensors 184 for the acquisition of measurements (i.e., sensor data) pertaining to the wellbore 102, the formation 106, and/or the BHA 124. For example, the downhole sensors 184 may be or comprise a downhole rotation sensor 184 operatively connected with and/or disposed in association with the drill bit 126, the downhole motor 182, and/or other portions of the BHA 124. The rotation sensor 184 may be operable to output or otherwise facilitate downhole rotational measurements (i.e., rotational data) indicative of rotational (i.e., angular) position of the drill bit 126. The rotational measurements may be further indicative of rotational distance (e.g., number of rotations), rotational speed, and rotational acceleration of the drill bit 126. The rotation sensor 184 may be or comprise, for example, at least one of an encoder, a rotary potentiometer, and a rotary variable-differential transformer (RVDT).

The control system 200 may comprise a surface rotation sensor 208 operatively connected with and/or disposed in association with the top drive 116. The rotation sensor 208 may be operable to output or otherwise facilitate surface rotational measurements (i.e., rotational data) indicative of rotational position of the drive shaft 125 of the top drive 116. The rotation sensor 208 may be disposed or installed in association with, for example, the electric motor 202 to monitor rotational position of the electric motor 202, and thus the drive shaft 125. The rotation sensor 208 may be disposed or installed in association with, for example, the drive shaft 125 to monitor rotational position of the drive shaft 125. The rotational measurements may be further indicative of rotational distance, rotational speed, and rotational acceleration of the drive shaft 125 of the top drive 116. The rotation sensor 208 may be or comprise, for example, at least one of an encoder, a rotary potentiometer, and an RVDT.

The control system 200 may further comprise one or more electrical devices, each operable to output or otherwise facilitate torque measurements (i.e., torque data) indicative of torque generated, output, or facilitated by the top drive 116. For example, the control system 200 may comprise a torque sensor 210 (e.g., a torque sub, a load cell, etc.) operable to output or otherwise facilitate torque measurements indicative of torque that was output by the drive shaft 125 of the top drive 116 to the drill string 120. The torque sensor 210 may be mechanically connected or otherwise disposed between the drive shaft 125 and the upper end of the drill string 120, such as may permit the torque sensor 210 to transfer and measure torque. The torque sensor 210 may also be or comprise a rotation sensor operable to facilitate determination of rotational position, rotational distance, rotational speed, and rotational acceleration of the drive shaft 125.

The control system 200 may comprise one or more control devices 204 (e.g., equipment controllers, information processing devices, etc.), such as, for example, variable frequency drives (VFDs), programmable logic controllers (PLCs), computers (PCs), industrial computers (IPC), or other equipment controllers furnished with control logic, communicatively connected with various sensors and actuators of the BHA 124, the top drive 116, and/or other portions of the control system 200. One or more of the control devices 204 may be in real-time communication with such sensors and actuators, and utilized to monitor and/or control various portions, components, and equipment of the top drive 116 and/or the BHA 124. For example, one or more of the control devices 204 may be communicatively connected with the rotation sensor 208 and operable to receive the rotational speed measurements 232 facilitated by the rotation sensor 208. One or more of the control devices 204 may be communicatively connected with the torque sensor 210 and operable to receive the torque measurements 234 facilitated by the torque sensor 210. One or more of the control devices 204 may be communicatively connected with a downhole rotation sensor 184 and operable to receive downhole rotational speed measurements 236 indicative of rotational speed of the drill bit 126 and/or another portion of the BHA 124. Communication between the downhole rotation sensor 184 and the control devices 204 may be via mud-pulse telemetry 237 sent by the downhole telemetry device 186 to the surface telemetry device 149 through the drilling fluid flowing within the fluid passage 121 of the drill string 120. Communication between one or more of the control devices 204, the surface telemetry device 149, and the sensors 208, 210, may be via wired and/or wireless communication means 206. A person having ordinary skill in the art will appreciate that such communication means are within the scope of the present disclosure.

The control devices 204 may be divided into or otherwise comprise hierarchical control levels or layers. A first control level may comprise a first control device 212 (i.e., an actuator control device), such as a VFD operable to directly power and control (i.e., drive) the electric motor 202 of the top drive 116. The first control device 212 may store and be operable to execute corresponding computer program code instructions 220, which when executed, may cause the first control device 212 to monitor and/or control the electric motor 202. The first control device 212 may be electrically connected with the electric motor 202 and/or supported by or disposed in association with the top drive 116. The first control device 212 may be operable to control rotational speed and torque of the electric motor 202, and thus control rotational speed of and torque output by the drive shaft 125 of the top drive 116. The first control device 212 may control electrical power (e.g., current, voltage, and/or frequency) delivered to the electric motor 202. The first control device 212 may be further operable to calculate or determine torque and/or rotational speed generated or output by the electric motor 202, such as based on the electrical power (e.g., current, voltage, and/or frequency) delivered to the electric motor 202. The first control device 212 may thus be operable to output or otherwise facilitate the torque measurements 234 indicative of torque output to the drill string 120 by the top drive 116. The first control device 212 may be communicatively connected with one or more of the other control devices 204 and operable to output the torque measurements 234 to one or more of the other control devices 204. The first control device 212 may be further operable to output or otherwise facilitate rotational speed measurements 232 and/or acceleration measurements indicative of rotational speed and/or acceleration of the top drive 116.

A second control level may comprise a second control device 214 (i.e., a local or direct control device), such as a PLC operable to control the electric motor 202 of the top drive 116 via the first control device 212. The second control device 214 may store and be operable to execute corresponding computer program code instructions 220, which when executed, may cause the second control device 214 to control the motor 202 and/or other actuators communicatively connected to the second control device 214. The second control device 214 may be a local control device disposed in association with the top drive 116 or another portion of the drill string drive system and operable to control the top drive 116 and/or other portions of the drill string drive system. The second control device 214 may be communicatively connected with the first control device 212 and operable to receive the torque measurements 234 from the first control device 212 and output control commands (i.e., control data or signals) to the first control device 212 to control the rotational position, rotational distance, rotational speed, and/or torque of the motor 202, and thus the drive shaft 125 of the top drive 116. The second control device 214 may be communicatively connected with the rotation sensor 208 and operable to receive rotational measurements, including the position measurements, the rotational distance measurements, the rotational speed measurements 232, and/or the rotational acceleration measurements facilitated by the rotation sensor 208. The second control device 214 may be further communicatively connected with the torque sensor 210 and operable to receive the torque measurements 234 facilitated by the torque sensor 210. The second control device 214 may also be communicatively connected with the surface telemetry device 149 and operable to receive the rotational speed measurements 236 facilitated by the rotation sensor 184.

A third control level may comprise a third control device 216 (i.e., a central or coordinated control device), such as a PC, an IPC, and/or another processing device. The third control device 216 may store and be operable to execute corresponding computer program code instructions 220, which when executed, may cause the third control device 216 to control the electric motor 202 and/or other actuators communicatively connected to the third control device 216. The program code instructions 220 may include high level programming languages, such as C, and C++, among other examples, and may be used with program code instructions running in a real time operating system (RTOS). The third control device 216 may be a system-wide control device operable to control a plurality of devices and/or subsystems of the well construction system 100. The third control device 216 may be or form at least a portion of the control device 192 shown in FIG. 1. The third control device 216 may be operable to control the electric motor 202 of the top drive 116 via the first and/or second control devices 212, 214. The third control device 216 may be communicatively connected with the second control device 214 and operable to receive the torque measurements 234 and the rotational speed measurements 232 from the first control device 212 via the second control device 214. The third control device 216 may also or instead be communicatively connected directly with the first control device 212 and operable to receive the torque measurements 234 and the rotational speed measurements 232 directly from the first control device 212. The third control device 216 may also or instead be communicatively connected with the rotation sensor 208 and operable to receive the rotational position measurements, the rotational distance measurements, the rotational speed measurements 232, and/or the rotational acceleration measurements facilitated by the rotation sensor 208. The third control device 216 may also or instead be communicatively connected with the torque sensor 210 and operable to receive the torque measurements 234 facilitated by the torque sensor 210. The third control device 214 may also or instead be communicatively connected with the surface telemetry device 149 and operable to receive the rotational speed measurements 236 facilitated by the rotation sensor 184. The third control device 216 may be operable to output control commands (i.e., control data or signals) directly to the first control device 212 or indirectly via the second control device 214 to control the rotational position, the rotational distance, the rotational speed, and/or the torque of the motor 202.

The present disclosure is further directed to various implementations of systems and methods (e.g., processes, operations, etc.) for monitoring and controlling drilling operations to increase performance (e.g., increase rate of penetration) of the drilling operations, such as by reducing stick-slip of the drill string 120. For example, the control system 200 according to one or more aspects of the present disclosure may be used in association with the well construction system 100. The control system 200 may be used to control the drill string 120 during drilling operations for drilling the wellbore 102. The control system 200 may include, utilize, or otherwise be implemented by hardware and/or the computer program code instructions 220 for controlling rotation of the drill string 120 to prevent, mitigate, inhibit, or otherwise reduce rotational waves (e.g., torsional vibrations, oscillations, and/or resonances) at the fundamental frequency and higher order resonant frequencies that are traveling along the drill string 120 caused by stick-slip at the lower end and/or other locations along the drill string 120.

The control system 200 may control the top drive 116 (or another driver, such as a rotary table) operable to rotate the drill string 120 to drill the wellbore 102. The control system 200 may comprise one or more control devices 204 each comprising a processor and a memory storing the executable computer program code instructions 220, wherein the instructions 220 comprise a stick-slip algorithm 222 for causing the top drive 116 to rotate the drill string 120 to perform drilling operations while reducing the rotational waves travelling along the drill string 120. One or more of the control devices 204 may receive input data 226, 228, 230 and incorporate (i.e., insert) the input data 226, 228, 230 into the stick-slip algorithm 222 to complete and/or configure the stick-slip algorithm 222. The control devices 204 may also receive the sensor measurements 232, 234, 236 indicative of operational status of the drill string 120 to update the stick-slip algorithm 222 and measure the reduction of rotational waves traveling along the drill string 120. During the drilling operations, the control devices 204 may output an intended rotational speed control command 224 (i.e., intended rotational speed set-point) and/or an intended torque control command 244 (i.e., intended torque set-point) based on the input data 226, 228, 230 and sensor measurements 232, 234, 236, thereby causing the top drive 116 to vary rotational speed of and/or torque input to the drill string 120 based on the rotational speed command 224 and/or the torque command 244, respectively, to reduce amplitude of the rotational waves traveling along the drill string 120.

Systems and methods according to one or more aspects of the present disclosure may be caused or otherwise facilitated by the computer program code instructions 220 comprising the stick-slip algorithm 222 stored on (i.e., entered, installed, programmed, etc.) one or more of the control devices 204 of the control system 200. The computer program code instructions 220 according to one or more aspects of the present disclosure may be, comprise, or be implemented in software, firmware, middleware, microcode, hardware description languages, or a combination thereof, which may be stored in a machine readable medium, such as a memory medium, of one or more of the control devices 204. The computer program code instructions 220 may represent or otherwise implement a procedure, a function, a subprogram, a program, an algorithm, an equation, a routine, a subroutine, a module, a software package, a class, or a combination of instructions, data structures, or program statements. Portions of the computer program code instructions 220 may be coupled together or with a hardware circuit by passing and/or receiving information, data, arguments, parameters, or memory contents. Information, arguments, parameters, and/or data may be passed, forwarded, or transmitted via a suitable means including memory sharing, message passing, token passing, and/or network transmission.

As described herein, the rotational waves may travel in upward (i.e., uphole) and downward (i.e., downhole) directions along the drill string 120 while the drill string 120 is rotated within the wellbore 102. The upward traveling rotational waves may be reflected at the surface 104 (e.g., by the top drive 116) forming downward traveling rotational waves, which may cause or exacerbate rotational resonances and repetitive stick-slip motion along and/or at the lower end of the drill string 120. In a drill string 120 having larger diameter drill pipe near the surface 104, some of the upward traveling rotational waves may be reflected before they reach the surface 104. The downward traveling rotational waves in the drill string 120 may also include those initiated by the top drive 116 (or another driver) while the top drive 116 rotates the drill string 120. The downward traveling rotational waves produced by the top drive 116 may drive the drill bit 126 through the formation 106. Thus, the downward traveling energy comprises intended downward traveling energy that is utilized to drive the drill bit 126 and unintended (i.e., undesirable) downward traveling energy that causes or exacerbates the rotational waves and/or stick-slip motion of the drill string 120.

The stick-slip algorithm 222 according to one or more aspects of the present disclosure may cause or otherwise facilitate methods, processes, and/or operations described herein. For example, the stick-slip algorithm 222 may facilitate control of the top drive 116 (or another driver) to control rotation of the drill string 120 to perform the drilling operations while reducing rotational waves traveling along the drill string 120. The stick-slip algorithm 222, when executed by one or more of the control devices 204, may thus facilitate control of the rotational waves traveling along the drill string 120 and other tubular strings, such as liner and casing strings, during well completion operations. For example, the stick-slip algorithm 222 may cause the top drive 116 to vary rotational speed of the drill string 120 to absorb, dampen, or otherwise reduce the upward traveling rotational waves, thereby preventing, mitigating, inhibiting, or otherwise reducing corresponding reflected downward traveling rotational waves, resonances, and other vibrations along and/or at the lower end of the drill string 120 and the resulting stick-slip motion of the drill string 120. The stick-slip algorithm 222 may be utilized to achieve and maintain an intended average (i.e., nominal) rotational speed of the upper end of the drill string 120 (i.e., at the top drive 116) while reducing or minimizing vibrations and/or stick-slip motion of the drill string 120. Accordingly, one or more control devices 204 of the control system 200 may be operable to execute or otherwise utilize the stick-slip algorithm 222 to determine an intended rotational speed and/or torque of the top drive 116 that reduces unintended rotational waves travelling along the drill string 120.

The stick-slip algorithm 222 according to one or more aspects of the present disclosure may be derived and implemented via mathematical equations modeling or otherwise characterizing portions of the drilling equipment, such as the drill string 120 and/or the top drive 116, and utilized to control the top drive 116. For example, relationship between rotational speed and torque with respect to the drill string 120 and the top drive 116 may be characterized or otherwise expressed as set forth below in Equation (1), which may be used to control rotational speed of the top drive 116.

$$v(t) = v_0(t) + r(t) + \left(k_1 v - k_2 \frac{T_{ic}}{z}\right)^f \tag{1}$$

where v(t) is the intended rotational speed control command 224 (i.e., control signal) of the top drive 116, $v_0(t)$ is an intended average (nominal) rotational speed set-point 226 (i.e., average rotational speed input) of the drill string 120 at the surface 104 that is to be imparted by the top drive 116 rotating the drill string 120 to drill the wellbore 102, r(t) is a residual correction integral term used to account for the long term average of the intended rotational speed control command v(t), v is a present measured rotational speed (i.e., present rotational speed input) of the top drive 116, $T_{ic}$ is a present measured or calculated estimate value of inertia-corrected torque (i.e., present inertia-corrected torque input) applied by the top drive 116 to the drill string 120, and z is a measured or calculated estimate of compliance (i.e., present compliance input) of the drill string 120. f signifies a filter being applied to the quantity inside the parentheses. $k_1$ and $k_2$ are dimensionless speed and torque proportionality constants, used to vary sensitivity of the intended rotational speed control command v(t) to present rotational speed and torque measurements or estimates, respectively.

The residual correction integral r(t) may be calculated via Equation (2) set forth below.

$$r(t)=\int k(v_0(t)-v(t))dt \tag{2}$$

where k is a speed integral constant comprising dimensions of 1/time.

The present inertia-corrected torque $T_{ic}$ applied by the top drive 116 to the drill string 120 can be measured by a torque sensor (e.g., the torque sub 210). The present inertia-corrected torque $T_{ic}$ can be calculated via Equation (3) set forth below.

$$T_{ic} = T_{td} - k_{tdj} J_{td} \frac{dv}{dt} \tag{3}$$

where $T_{td}$ is a top drive torque, which is torque exerted by the top drive 116, which can be measured by measuring electrical current drawn by the electric motor 202 driving the top drive 116. $J_{td}$ is a rotational inertia of the top drive 116, and $$\frac{dv}{dt}$$

is a time rate of change of the measured rotational speed (i.e., rotational acceleration) of the top drive 116, which may be low-pass filtered too remove high frequency noise. $k_{tdj}$ is a dimensionless inertial compensation constant, which may be used to vary sensitivity of the present inertia-corrected torque $T_{ic}$ to the rotational inertia $J_{td}$ of the top drive 116 and the time rate of change of the measured rotational speed $$\frac{dv}{dt}$$

of the top drive 116. The control loop characterized by Equations (1)-(3) used to output the intended rotational speed control command 224 to the top drive 116 may be or comprise a portion of the stick-slip algorithm 222 stored on and executed by the third control device 216.

The intended rotational speed control command v(t) output by Equation (1) set forth above may be sent to a speed control loop portion of a stick-slip algorithm 222 of the control system 200 for controlling the top drive 116. The speed control loop may be characterized or otherwise expressed as set forth below in Equation (4), which may be used to control torque output by the top drive 116.

$$T_{sp}=k_p(v_0(t)-v(t))+\int k_i(v_0(t)-v(t))dt \tag{4}$$

where $T_{sp}$ is the intended torque control command 244 (i.e., control signal) of the electric motor 202 that is to be applied to the top drive 116. $k_p$ and $k_i$ are proportional and integral constants, respectively. The control loop characterized by Equation (4) used to output the intended torque control command 244 to the top drive 116 may be or comprise a portion of the stick-slip algorithm 222 stored on and executed by the first control device 212.

Thus, the manner in which the stick-slip algorithm 222 characterized or otherwise expressed by Equations (1)-(4) controls rotation of the top drive 116 can be controlled via a plurality of numerical parameters 230, such as the constants of the Equations (1)-(4). The numerical parameters 230 my include the speed proportionality constant $k_1$, the torque proportionality constant $k_2$, the speed integral constant k, the inertial compensation constant $k_{tdj}$, the speed control loop proportional constant $k_p$, the speed control loop integral constant $k_i$, and one or more filtering parameters f, such as a bandpass filter that can be applied to control and/or feedback signals to control or vary an upper and a lower frequency of control and/or feedback signals. Because the numerical parameters 230 control the manner in which the stick-slip algorithm 222 controls rotation of the top drive 116, such numerical parameters 230 may also be referred to as control parameters.

The stick-slip algorithm 222 within the scope of the present disclosure, such as implemented by one or more of the Equations (1)-(4), may be contained within or captured by the computer program code instructions 220, which may be executed or otherwise implemented by one or more of the control devices 204 of the control system 200, such as by determining and outputting control commands 224, 244 (i.e., control data or signals) indicative of intended rotational speed v(t) and intended torque $T_{sp}$ of the top drive 116. However, it is to be understood that the stick-slip algorithm 222 implemented by one or more of the Equations (1)-(4) is merely an example stick-slip algorithm. Therefore, it is to be further understood that the control system 200 within the scope of the present disclosure may utilize or otherwise implement computer program code instructions 220 comprising other stick-slip algorithms (i.e., implemented by other equations) for controlling rotational speed and/or torque of the top drive 116 to reduce rotational waves (e.g., torsional vibrations, oscillations, and/or resonances) traveling along the drill string 120. It is to be also understood that a stick-slip algorithm 222 within the scope of the present disclosure may be combined with or work in association with one or more other algorithms to control rotational speed and/or torque of the top drive 116 or another driver of the drill string 120.

The computer program code instructions 220 comprising the stick-slip algorithm 222 may be stored on (i.e., entered, installed, programmed, etc.) and executed by one or more of the control devices 204. For example, a portion of the stick-slip algorithm 222 stored on the third control device 216 may be implemented by one or more of the Equations (1)-(3) to determine (i.e., calculate) and output the intended rotational speed control command 224 (i.e., control signal) for controlling the rotational speed (e.g., revolutions per minute (RPM)) of the top drive 116, and thus rotational speed of the upper end of the drill string 120. Prior to and/or during drilling operations, the third control device 216 may receive various input data 226, 228, 230, 232, 234, incorporate (i.e., insert) the input data 226, 228, 230, 232, 234 into the stick-slip algorithm 222 to complete and/or configure the stick-slip algorithm 222, and then execute the stick-slip algorithm 222 based on the received input data 226, 228, 230, 232, 234 to determine the intended rotational speed control command 224. The intended rotational speed control command 224 may be or comprise the intended rotational speed control command v(t) determined via Equations (1)-(3).

The input data may comprise an intended average (i.e., nominal) rotational speed set-point 226 of the top drive 116 to control the average rotational speed of the upper end of the drill string 120. The intended average rotational speed set-point 226 may be or comprise the intended average rotational speed set-point $v_0(t)$ described above in association with one or more of the Equations (1)-(3). The input data may further comprise equipment physical specifications 228 (e.g., mechanical properties or characteristics) of the drilling equipment, including physical specifications of the top drive 116 and/or the drill string 120. For example, the equipment physical specifications 228 may comprise the compliance z of the drill string 120 and the rotational inertia $J_{td}$ of the top drive 116, as described above in association with one or more of the Equations (1)-(3). The drill string compliance z may be determined prior to being transmitted to the third control device 216 based on certain drill string specifications, and then transmitted to the third control device 216. The input data may further comprise the numerical parameters 230 (e.g., terms, coefficients, constants, variables, etc.) of the stick-slip algorithm 222. For example, the numerical parameters 230 may comprise the stick-slip algorithm constants k, $k_1$, $k_2$, $k_p$, $k_i$, and $k_{tdj}$ described above in association with one or more of the Equations (1)-(4). The input data 226, 228, 230 may be entered into the third control device 216 by personnel (e.g., rig personnel, research and development personnel, engineers, etc.) using the control workstation 197 or another HMI, such as a keyboard, communicatively connected with the third control device 216. The input data 226, 228, 230 may also or instead be entered into the third control device 216 automatically by another control device.

The input data may also comprise present (i.e., real-time) operational measurements of the top drive 116, such as present rotational speed measurements 232 of the top drive 116 facilitated by the rotation sensor 208 and present torque measurements 234 (e.g., present inertia-corrected torque measurements) of the top drive 116 facilitated by the torque sensor 210. The rotational speed measurements 232 and the torque measurements 234 may be or comprise the present rotational speed v of the top drive 116 and the present value of inertia-corrected torque $T_{ic}$ of the top drive 116, respectively, as described above in association with one or more of the Equations (1)-(4). The torque measurements 234 may also or instead be derived based on Equation (3) by solving for the present value of inertia-corrected torque $T_{ic}$. For example, top drive torque $T_{td}$ can be derived based on electrical current drawn by the electric motor 202 driving the top drive 116. Information indicative of the top drive torque $T_{td}$ and/or electrical current drawn by the electric motor 202 may be output by the first control device 212 and transmitted to the third control device 216. The third control device 216 may then calculate the present value of inertia-corrected torque $T_{ic}$ c based on the top drive torque $T_{td}$, the rotational inertia $J_{td}$ of the top drive 116, and the time rate of change $$\frac{dv}{dt}$$

of the rotational speed measurements 232 of the top drive 116.

When the stick-slip algorithm 222 is completed and/or configured with the input data 226, 228, 230, 232, 234, the third control device 216 may execute the stick-slip algorithm 222 based on the input data 226, 228, 230, 232, 234 to determine the intended rotational speed control command 224. The determined intended rotational speed control command 224 may then be output (i.e., communicated) directly to the first control device 212 associated with the motor 202 of the top drive 116 or indirectly via the second control device 214. The intended rotational speed control command 224 may be or comprise a proportional and integral (PI) gain value to be used by the first control device 212 utilizing PI rotational speed control.

Although the control system 200 shows the algorithm 222 stored and executed by the third control device 216, it is to be understood that at least a portion of the algorithm 222 may also or instead be stored and executed by the first control device 212 and/or the second control device 214. Accordingly, the first control device 212 and/or the second control device 214 may also or instead receive the input data 226, 228, 230, 232, 234, incorporate the input data 226, 228, 230, 232, 234 into the stick-slip algorithm 222 to complete and/or configure the stick-slip algorithm 222, and then execute the stick-slip algorithm 222 to determine and output the intended rotational speed control command 224.

At least a portion of the computer program code instructions 220 comprising the stick-slip algorithm 222 may be stored on (i.e., entered, installed, programmed, etc.) and executed by the first control device 212. For example, a portion of the stick-slip algorithm 222 comprising Equation (4) may be stored on and executed by the first control device 212. The portion of the stick-slip algorithm 222 comprising Equation (4) may determine (i.e., calculate or compute) and output an intended torque control command 244 (i.e., a control signal or set-point) indicative of torque that is to be applied by the top drive 116 to the upper end of the drill string 120. The first control device 212 may receive various input data, incorporate the input data into the stick-slip algorithm 222 to complete and/or configure the stick-slip algorithm 222, and then execute the stick-slip algorithm 222 based on the received input data to determine the intended torque control command 244. The intended torque control command 244 may be or comprise the intended torque control command $T_{sp}$ determined via Equation (4).

The first control device 212 may receive from the third control device 216 both the intended rotational speed control command 224 determined by the third control device 216 and the intended average rotational speed set-point 226 of the top drive 116. The first control device 212 may also receive additional numerical parameters 230 to configure the stick-slip algorithm 222. For example, the numerical parameters 230 received by the first control device 212 may include one or more numerical parameters of the stick-slip algorithm 222, such as the stick-slip algorithm constants $k_p$ and $k_i$ described above in association with the Equation (4). As described above, the numerical parameters 230 may be entered into the third control device 216 by personnel using the control workstation 197 or another HMI, such as a keyboard, communicatively connected with the third control device 216 and then transmitted to the first control device 212 from the third control device 216.

When the stick-slip algorithm 222 is completed and/or configured with the input data 224, 226, 230, the first control device 212 may execute the stick-slip algorithm 222 based on the input data 224, 226, 230 to determine and output the intended torque control command 244. The first control device 212 may then operate or otherwise control the motor 202 of the top drive 116 to cause the motor 202 to output a level of torque indicated by the intended torque control command 244, and thereby control the rotational speed of the drill string 120 to reduce the rotational waves traveling along the drill string 120 while performing the drilling operations.

The third control device 216 may continually receive the rotational speed measurements 232 and the torque measurements 234, and use such measurements 232, 234 as feedback input data (i.e., feedback signals or information). The third control device 216 may then continually update (e.g., recalculate) the intended rotational speed control command 224 via the stick-slip algorithm 222 based on the measurements 232, 234. The updated intended rotational speed control command 224 may then be communicated to the first control device 212 directly or via the second control device 214. The first control device 212 may then continually update the intended torque control command 244 via the stick-slip algorithm 222 based on the updated intended rotational speed control command 224. The first control device 212 may then operate or otherwise control the motor 202 of the top drive 116 to cause the motor 202 to output level of torque as indicated by the updated intended torque control command 244 to reduce the rotational waves traveling along the drill string 120 while performing the drilling operations. Thus, the third control device 216 may continually receive the updated rotational speed measurements 232 and the updated torque measurements 234, such as may permit the first control device 212 to continually update the intended torque control command 244 to continually change the torque output by the motor 202 to continually change the rotational speed of the drill string 120 to reduce the rotational waves traveling along the drill string 120 while performing the drilling operations.

As described above, the manner in which the stick-slip algorithm 222 characterized or otherwise expressed by Equations (1)-(4) controls rotation of the top drive 116 and the drill string 120 can be controlled by controlling (e.g., changing, adjusting, etc.) the numerical parameters 230 of the stick-slip algorithm 222. The numerical parameters 230 may be or comprise the constants of the stick-slip algorithm Equations (1)-(4), including the speed proportionality constant $k_1$, the torque proportionality constant $k_2$, the speed integral constant k, the inertial compensation constant $k_{tdj}$, the speed control loop proportional constant $k_p$, the speed control loop integral constant $k_i$, and one or more filtering parameters f, such as a bandpass filter that can be applied to control and/or feedback signals to control or vary an upper and a lower frequency of control and/or feedback signals. An optimal set of numerical parameters 230 may be selected to optimize performance of the stick slip algorithm 222 to reduce the rotational waves traveling along the drill string 120 in an optimal manner while performing the drilling operations. Accordingly, the present disclosure is further directed to various implementations of systems and methods (e.g., processes, operations, etc.) for selecting or otherwise determining an optimal set of the numerical parameters 230 to optimize performance of the stick-slip algorithm 222.

An optimal set of numerical parameters of a stick-slip algorithm may be selected based on actual (i.e., measured) drilling performance. For example, performance of a stick-slip algorithm may be monitored during a drilling test run of the control system 200 utilizing the stick-slip algorithm 222 on an actual drilling rig while performing drilling operations. During the drilling test run, drilling operations may be performed while the numerical parameters 230 of the stick-slip algorithm 222 are changed (i.e., varied) and behavior (i.e., operational parameters) of the drill string 120 is monitored. The personnel and/or a control device may analyze the behavior of the drill string 120 while the numerical parameters 230 change to determine the performance of the stick-slip algorithm 222 in terms of ability to reduce the amplitude of rotational waves traveling along the drill string 120 caused by stick-slip while utilizing each different set of numerical parameters 230 to complete and/or configure the stick-slip algorithm 222. The behavior of the drill string 120 can be defined or characterized by monitoring (i.e., measuring) for fluctuations operational parameters, such as downhole rotational speed and/or surface torque. The downhole rotational speed may be measured via the downhole rotational speed sensor 184 operable to facilitate rotational speed measurements 236 indicative of rotational speed of the drill bit 126 and/or another portion of the BHA 124. Rotational speed data output by the downhole rotational speed sensor 184 may be transmitted to the wellsite surface via downhole to surface telemetry 237 facilitated by the telemetry devices 186, 149. The surface torque may be measured by the torque sensor 210 and/or calculated based on electrical current drawn by the motor, as described above. One or more of the control devices 204 may then determine amplitude of downhole rotational speed fluctuations and the surface torque fluctuations based on the downhole rotational speed measurements 236 and the surface torque measurements 234, respectively.

FIG. 3 is table 300 showing behavior of the drill string 120 controlled by the control system 200 shown in FIG. 2 utilizing the stick-slip algorithm 222 that is completed and/or configured, one at a time, by six different sets 302 of numerical parameters 230 during test drilling operations performed by the well construction system 100 shown in FIG. 1. Accordingly, the following description refers to FIGS. 1-3, collectively.

For each set 302 of the numerical parameters 230, the table 300 shows average percentage (%) surface torque fluctuation 304 when the stick-slip algorithm 222 is not utilized (i.e., turned off), and average percentage (%) surface torque fluctuation 306 when the stick-slip algorithm 222 is utilized (i.e., turned on). For each set 302 of the numerical parameters 230, the table 300 further shows percentage (%) surface torque fluctuation reduction 308, an average percentage (%) downhole rotational speed fluctuation 310 when the stick-slip algorithm 222 is not utilized, an average percentage (%) downhole rotational speed fluctuation 312 when the stick-slip algorithm 222 is utilized, and percentage (%) downhole rotational speed fluctuation reduction 314. The table 300 shows that the numerical parameter "Set 1" and "Set 6" cause the highest percentage (%) reduction in downhole rotational speed fluctuations 308 at 68.93% and 78.61%, respectively, and the highest percentage (%) reduction in surface torque fluctuations 314 at 82.50% and 86.14%, respectively. Because numerical parameter "Set 6" resulted in the highest percentage (%) reduction in downhole rotational speed and surface torque fluctuations, the numerical parameters 230 of the numerical parameter "Set 6" may be utilized in the stick-slip algorithm 222 to optimize performance of the stick-slip algorithm 222, and thus reduce the rotational waves traveling along the drill string 120 in an optimal manner while performing the drilling operations.

Thus, a plurality of different sets of numerical parameters 230 may be selected and then, during a drilling test and one at a time, incorporated (i.e., inserted) into the stick-slip algorithm 222 to complete and/or configure the stick-slip algorithm 222 stored on and operable to be executed by the control system 200 while monitoring (i.e., measuring)

operational parameters of the drill string 120. In other words, an optimal set of the numerical parameters 230 may be determined by varying the numerical parameters 230 and analyzing surface and/or downhole operational measurements 234, 236 in real-time while performing the drilling test. The operational measurements 234, 236 may also or instead be recorded and analyzed at a later time. After the drilling test is performed, the optimal set of numerical parameters 230 may be selected based on the analysis of the operational measurements 234, 236, such as the ability to reduce the amplitude of rotational waves traveling along the drill string 120. Thus, the optimal set of numerical parameters 230 may cause or otherwise be associated with the rotational waves having the lowest (or smallest) determined amplitudes (or largest decrease in the amplitude of the rotational waves). The optimal set of numerical parameters 230 may then be incorporated into the stick-slip algorithm 222 to perform the drilling operations. The test drilling operations, the selection of different sets of numerical parameters 230, the selection of the optimal set of numerical parameters 230, and incorporation of the optimal set of numerical parameters 230 into the stick-slip algorithm 222 may be initiated or otherwise performed manually by personnel or automatically by the control system 200.

Instead of performing test drilling operations using actual (i.e., real world) well construction equipment, an optimal set of the numerical parameters of a stick-slip algorithm may instead be selected based on computer (i.e., virtual) simulations of such drilling operations, including computer simulations of a drill string being rotated by a driver (e.g., the top drive 116 or a rotary table) to drill a wellbore through a subterranean formation. The computer simulations may also simulate control of the driver via the stick-slip algorithm to reduce the rotational waves traveling along the drill string. Thus, the computer simulations according to one or more aspects of the present disclosure may comprise performing the operations of the test drilling operations described above, except that one or more aspects of such test drilling operations is performed virtually on a processing device (e.g., processing device 400 shown in FIG. 4), such as a PLC, a PC, or an IPC.

A computer simulation may comprise or utilize a numerical simulation (i.e., a mathematical model) of the drilling equipment, including a top drive and a drill string. The numerical simulation may include the use of a stick-slip algorithm for controlling the drilling equipment, such that stick-slip control of the drill string can be applied to the numerical simulation of the drilling equipment and the resulting behavior (i.e., operational parameters) of the drill string predicted. To model the stick-slip behavior, the numerical simulation of the drilling equipment may include, for example, axial and/or rotational degrees of freedom, axial and/or rotational wave propagation, wellbore friction, and interaction between a drill bit and a rock formation.

During simulated drilling operations, the numerical parameters may be changed (i.e., varied) and simulated behavior of the drill string monitored. Personnel (e.g., research and development personnel, computer programmers, engineers, etc.) and/or a processing device may analyze the behavior of the drill string while the numerical parameters change to determine the performance of the stick-slip algorithm in terms of its ability to reduce the rotational waves traveling along the drill string 120 caused by stick-slip while utilizing each different set of numerical parameters. The behavior of the drill string may be defined or characterized by monitoring simulated operational parameters, such as downhole rotational speed fluctuations and/or surface torque fluctuations along the drill string. After the simulated drilling operations are performed, an optimal set of numerical parameters may be selected based on ability to inhibit or reduce the rotational waves traveling along the drill string. The optimal set of numerical parameters may be incorporated into the stick-slip algorithm of the control system 200. Numerical optimization methods may be utilized to analyze the simulated operational parameters to identify or otherwise determine an optimal numerical parameter set. The simulation of the drilling operations, the selection of different sets of numerical parameters, the selection of the optimal set of numerical parameters, and incorporation of the optimal set of numerical parameters may be initiated or otherwise performed manually by the personnel or automatically by the processing device.

Thus, an optimal set of the numerical parameters may also or instead be determined based on virtual experiments simulating a drill string during drilling operations and effects of a control system utilizing a stick-slip algorithm on the simulated drill string. Numerical parameters of the stick-slip algorithm may be varied and surface and/or downhole operational parameters analyzed to determine the optimal set of numerical parameters.

A computer simulation may also or instead comprise or utilize a physics-based analytic model of the drilling equipment, including a top drive and a drill string. The analytic model may include the use of a stick-slip algorithm for controlling the drilling equipment, such that stick-slip control of the drill string can be applied to the analytic model of the drilling equipment and the resulting behavior (i.e., operational parameters) of the drill string predicted.

The analytic model may include a constrained optimization, whereby optimization techniques (e.g., simulated annealing, genetic algorithms, etc.) are used to find a set of numerical parameters that minimize, for example, the reflection coefficient over a predetermined frequency range (e.g., between about 0.05 Hertz (Hz) and about 1.00 Hz) while placing a constraint on a value of a reflection coefficient over another predetermined frequency range (e.g., between about one Hertz (Hz) and about four Hz). Additional constraints may include a maximum value and/or a minimum value of the reflection coefficient, wherein, for example, an overall minimum value of the reflection coefficient is 0.75 or less. While optimizing the numerical parameters, an objective may be to minimize the absolute value of the reflection coefficient of upgoing rotational waves at the surface. However, additional constraints and/or different criteria for minimizing the absolute value of the reflection coefficient may exist. Because the reflection coefficient is generally a complex number, the term "reflection coefficient" as used hereinafter, refers to an absolute value of the reflection coefficient.

A criteria for minimizing the reflection coefficient may include minimizing an average reflection coefficient, or a simple function of the reflection coefficient, over a frequency range for which high rotational oscillations are detected during drilling operations. Because rotational oscillations will not be problematic when the reflection coefficient is sufficiently low (e.g., less than 0.80), an example simple function may include taking the mean of an interval of the reflection coefficient, or the sufficiently low reflection coefficient, whichever is greater. However, reducing the reflection coefficient over one frequency range may come at the expense of increasing the reflection coefficient over another frequency range. For example, if the reflection coefficient is increased above 1.00, then such reflection coefficient increase may induce large rotational oscillations within a frequency range where no rotational oscillations existed without use of rotational control. Thus, an additional constraint may be to include a limit on the value of the reflection coefficient over a frequency range where the reflection coefficient is not subject to minimization. Such limit may itself be frequency varying because higher frequency oscillations may be subject to more natural dampening, and thus a higher reflection coefficient can be tolerated.

In addition to constraining the reflection coefficient, a top drive or another driver should not be used to deliver excessive torque. For a given set of numerical parameters, torque requirement for reflecting a unit amplitude upgoing wave as a function of frequency can be derived, and similarly to the limit placed on the reflection coefficient, a limit on the derived torque function may be imposed. The limit on the torque function may vary based on frequency. Another constraint may be that the control system incorporating a stick-slip algorithm utilizing numerical parameters is stable.

Thus, an optimal set of the numerical parameters may also or instead be determined based on a physics-based analytic model of surface equipment (e.g., a top drive) and a drill string. The model may then be used to simulate or predict behavior of the surface equipment and drill string based on different numerical parameters of the stick-slip algorithm to determine an optimal set of numerical parameters. Constrained optimizations of the behavior caused by the numerical parameters may be performed to determine an optimal set of numerical parameters.

Figure 4:
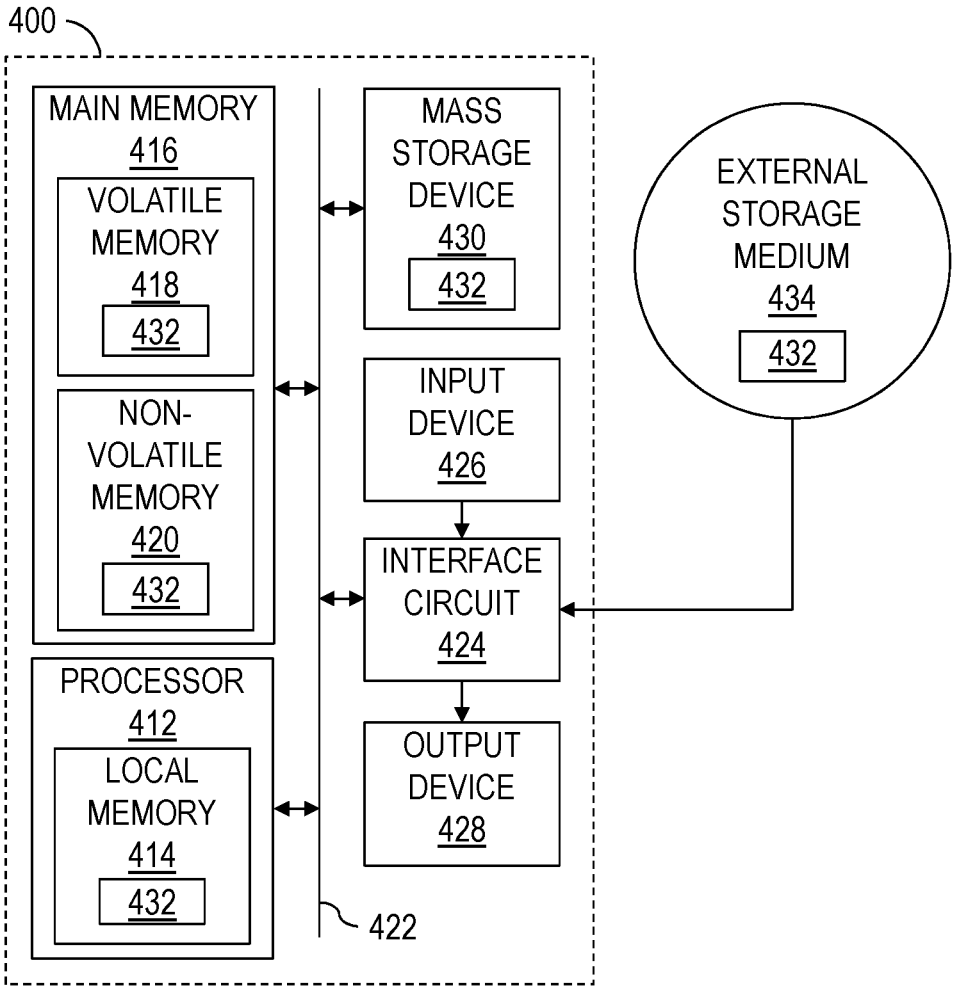
FIG. 4 is a schematic view of at least a portion of an example implementation of apparatus according to one or more aspects of the present disclosure.

FIG. 4 is a schematic view of at least a portion of an example implementation of a processing device 400 (or system) according to one or more aspects of the present disclosure. The processing device 400 may be or form at least a portion of one or more electronic devices shown in one or more of the FIGS. 1 and 2. Accordingly, the following description refers to FIGS. 1, 2, and 4, collectively.

The processing device 400 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 400 may be or form at least a portion of the control devices 188, 192 shown in FIG. 1. The processing device 400 may be or form at least a portion of the control devices 212, 214, 216 shown in FIG. 2. Although it is possible that the entirety of the processing device 400 is implemented within one device, it is also contemplated that one or more components or functions of the processing device 400 may be implemented across multiple devices, some or an entirety of which may be at the wellsite and/or remote from the wellsite.

The processing device 400 may comprise a processor 412, such as a general-purpose programmable processor. The processor 412 may comprise a local memory 414, and may execute machine-readable and executable program code instructions 432 (i.e., computer program code) present in the local memory 414 and/or another memory device. The processor 412 may execute, among other things, the program code instructions 432 and/or other instructions and/or programs to implement the example methods, processes, and/or operations described herein. For example, the program code instructions 432, when executed by the processor 412 of the processing device 400, may cause a top drive 116 to perform example methods and/or operations described herein. The program code instructions 432, when executed by the processor 412 of the processing device 400, may also or instead cause the processor 412 to receive and process the algorithm 222 and input data 226, 228, 230, 232, 234, and output control commands 224, 244 to the motor 202 of the top drive 116 based on the algorithm 222 and input data 226, 228, 230, 232, 234.

The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 412 include one or more INTEL microprocessors, microcontrollers from the ARM and/or PICO families of microcontrollers, embedded soft/hard processors in one or more FPGAs.

The processor 412 may be in communication with a main memory 416, such as may include a volatile memory 418 and a non-volatile memory 420, perhaps via a bus 422 and/or other communication means. The volatile memory 418 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The processing device 400 may also comprise an interface circuit 424, which is in communication with the processor 412, such as via the bus 422. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may comprise a graphics driver card. The interface circuit 424 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 400 may be in communication with various sensors, video cameras, actuators, processing devices, control devices, and other devices of the well construction system via the interface circuit 424. The interface circuit 424 can facilitate communications between the processing device 400 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 426 may also be connected to the interface circuit 424. The input devices 426 may permit human wellsite operators 195 to enter the program code instructions 432, which may be or comprise control commands, drilling equipment specifications, top drive specifications, drill string specifications, numerical parameters, operational parameters, operational thresholds, and/or other operational set-points. The program code instructions 432 may further comprise modeling or predictive routines, equations, algorithms, processes, applications, and/or other programs operable to perform example methods and/or operations described herein. The input devices 426 may be, comprise, or be implemented by a keyboard, a mouse, a joystick, a touchscreen, a track-pad, a trackball, an isopoint, and/or a voice recognition system, among other examples. One or more output devices 428 may also be connected to the interface circuit 424. The output devices 428 may permit for visualization or other sensory perception of various data, such as sensor data, status data, and/or other example data. The output devices 428 may be, comprise, or be implemented by video output devices (e.g., an LCD, an LED display, a CRT display, a touchscreen, etc.), printers, and/or speakers, among other examples. The one or more input devices 426 and the one or more output devices 428 connected to the interface circuit 424 may, at least in part, facilitate the HMIs described herein.

The processing device 400 may comprise a mass storage device 430 for storing data and program code instructions 432. The mass storage device 430 may be connected to the processor 412, such as via the bus 422. The mass storage device 430 may be or comprise a tangible, non-transitory storage medium, such as a floppy disk drive, a hard disk drive, a compact disk (CD) drive, and/or digital versatile disk (DVD) drive, among other examples. The processing device 400 may be communicatively connected with an external storage medium 434 via the interface circuit 424. The external storage medium 434 may be or comprise a removable storage medium (e.g., a CD or DVD), such as may be operable to store data and program code instructions 432.

As described above, the program code instructions 432 and other data (e.g., sensor data or measurements database) may be stored on (i.e., entered, installed, programmed, etc.) the mass storage device 430, the main memory 416, the local memory 414, and/or the removable storage medium 434. Thus, the processing device 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code instructions 432 (i.e., software or firmware) thereon for execution by the processor 412. The program code instructions 432 may include program instructions or computer program code that, when executed by the processor 412, may perform and/or cause performance of example methods, processes, and/or operations described herein.

The present disclosure is further directed to example methods (e.g., operations, processes, actions, etc.) for monitoring and controlling well construction equipment 110, 120 of a well construction system 100. In the following description, one or more descriptors and/or other references to such example methods may not be applicable to the entirety of one or more of the methods. That is, such references may instead be applicable to just one or more aspects of one or more of the methods. Thus, references to "the example methods" are to be understood as being applicable to the entirety of one or more of the methods and/or one or more aspects of one or more of the methods.

The example methods may be performed utilizing or otherwise in conjunction with one or more implementations of one or more instances of one or more components of the apparatus shown in one or more of FIGS. 1-4 and/or otherwise within the scope of the present disclosure. For example, the example methods may be at least partially performed (and/or caused to be performed) by a processing device (e.g., the processing device 500, the control devices 204, etc.) executing program code instructions according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be at least partially performed (or be caused to be performed) by a human operator (e.g., rig personnel, engineers, etc.) utilizing one or more implementations of one or more instances of one or more components of the apparatus shown in one or more of FIGS. 1-4 and/or otherwise within the scope of the present disclosure. Accordingly, the following description refers to apparatus shown in one or more of FIGS. 1-4 and example methods that may be performed by such apparatus. However, the example methods may also be performed in conjunction with implementations of apparatus other than those depicted in FIGS. 1-4 that are also within the scope of the present disclosure.

An example implementation of a method according to one or more aspects of the present disclosure may comprise commencing operation of a control system 200 for controlling a driver 116 of a drill string 120. The control system 200 may comprise a processor 412 and a memory 416 storing a computer program code 220, which may include a stick-slip algorithm 222. The operating control system 200 may receive a plurality of different numerical parameters 230, and for each of the different numerical parameters 230, incorporate the numerical parameter 230 into the stick-slip algorithm 222 and execute the stick-slip algorithm 222 to determine a control command 224, 244 that causes the driver 116 to rotate the drill string 120 to perform drilling operations while reducing amplitude of rotational waves travelling along the drill string 120. Before executing the stick-slip algorithm, the operating control system 200 may also receive an intended average rotational speed set-point 226 of the drill string 120, incorporate the intended average rotational speed set-point 226 of the drill string 120 into the stick-slip algorithm 222, receive specifications 228 of the drill string 120 and/or the driver 116, and incorporate the specifications 228 into the stick-slip algorithm 222. For each of the different numerical parameters 230, the operating control system 200 may output a different torque command 244 to the driver 116 thereby causing the driver 116 to output a different amount of torque to rotate the drill string 120.

The operating control system 200 may also receive torque measurements 234 indicative of torque at a corresponding portion (e.g., the upper end) of the drill string 120, determine (i.e., measure) the amplitude of the rotational waves travelling along the drill string 120 based on the torque measurements 234 for each of the different numerical parameters 230, and determine optimal ones of the different numerical parameters 230 based on the determined amplitudes of the rotational waves. The operating control system 200 may also receive rotational speed measurements indicative of rotational speed of a corresponding portion of the drill string, determine the amplitude of the rotational waves travelling along the drill string based on the rotational speed measurements for each of the different numerical parameters, and determine optimal ones of the different numerical parameters based on the determined amplitudes of the rotational waves. The optimal ones of the different numerical parameters 230 may cause or otherwise be associated with the rotational waves having the lowest (or smallest) determined amplitudes (or largest decrease in the amplitude of the rotational waves).

As described above, the numerical parameters 230 may be or comprise the constants of the stick-slip algorithm Equations (1)-(4), including the speed proportionality constant $k_1$, the torque proportionality constant $k_2$, the speed integral constant k, the inertial compensation constant $k_{tdj}$, the speed control loop proportional constant $k_p$, the speed control loop integral constant $k_i$, and one or more filtering parameters f, such as a bandpass filter that can be applied to control and/or feedback signals to control or vary an upper and a lower frequency of control and/or feedback signals.

Another example implementation of a method according to one or more aspects of the present disclosure may comprise commencing operation of a processing device 400 to run a computer simulation of a drill string 120 being rotated by a driver 116 to drill a wellbore 120, wherein rotation of the driver 116 is controlled by a stick-slip algorithm 222. The computer simulation run by the processing device 400 may be or comprise a numerical simulation. However, the computer simulation run by the processing device 400 may instead be or comprise a physics-based analytic model that utilizes constrained optimizations.

The operating processing device 400 may receive a plurality of different numerical parameters 230, and for each of the different numerical parameters 230, incorporate the numerical parameter 230 into the stick-slip algorithm 222 and execute the stick-slip algorithm 222 to determine a control command 224, 244 that causes the driver 116 to rotate the drill string 120 to perform drilling operations while reducing amplitude of rotational waves travelling along the drill string 120. Before executing the stick-slip algorithm, the operating processing device 400 may also receive an intended average rotational speed set-point 226 of the drill string 120, incorporate the intended average rotational speed set-point 226 of the drill string 120 into the stick-slip algorithm 222, receive specifications 228 of the drill string 120 and/or the driver 116, and incorporate the specifications 228 into the stick-slip algorithm 222. For each of the different numerical parameters 230, the operating processing device 400 may simulate output of a different torque command 244 to the driver 116 thereby causing the driver 116 to output a different amount of torque to rotate the drill string 120.

The operating processing device 400 may also determine the amplitude of the rotational waves travelling along the drill string 120 for each of the different numerical parameters 230, and determine optimal ones of the different numerical parameters 230 based on the determined amplitudes of the rotational waves. The optimal ones of the different numerical parameters 230 may cause or otherwise be associated with the rotational waves having the lowest (or smallest) determined amplitudes (or largest decrease in the amplitude of the rotational waves).

In view of the entirety of the present disclosure, including the figures and the claims, a person having ordinary skill in the art will readily recognize that the present disclosure introduces an apparatus comprising a control system operable to control a driver for rotating a drill string, wherein the control system comprises a processor and a memory storing a computer program code, wherein the computer program code comprises a stick-slip algorithm, and wherein the control system is operable to: (A) receive a plurality of different numerical parameters; and (B) for each of the different numerical parameters: (1) incorporate the numerical parameter into the stick-slip algorithm; and (2) execute the stick-slip algorithm to determine a control command that causes the driver to rotate the drill string to perform drilling operations while reducing rotational waves travelling along the drill string.

The control system may comprise a torque sensor operable to facilitate torque measurements indicative of torque at a corresponding portion of the drill string. In such implementations, among others within the scope of the present disclosure, the control system may be operable to: determine amplitude of the rotational waves travelling along the drill string based on the torque measurements for each of the different numerical parameters; and determine optimal ones of the different numerical parameters based on the determined amplitudes of the rotational waves, wherein the optimal ones of the different numerical parameters may be associated with the lowest of the determined amplitudes of the rotational waves. The torque sensor may be a surface torque sensor operable to facilitate torque measurements indicative of torque at an upper end of the drill string.

The control system may comprise a rotational speed sensor operable to facilitate rotational speed measurements indicative of rotational speed of a corresponding portion of the drill string. In such implementations, among others within the scope of the present disclosure, the control system may be operable to: determine amplitude of the rotational waves travelling along the drill string based on the rotational speed measurements for each of the different numerical parameters; and determine optimal ones of the different numerical parameters based on the determined amplitudes of the rotational waves, wherein the optimal ones of the different numerical parameters may be associated with the lowest of the determined amplitudes of the rotational waves. The rotational speed sensor may be a downhole rotational speed sensor operable to facilitate rotational speed measurements indicative of rotational speed at a lower end of the drill string.

The different numerical parameters may comprise at least one of a speed integral constant, a speed proportionality constant, and a torque proportionality constant.

Before executing the stick-slip algorithm, the control system may be operable to: receive an intended average rotational speed set-point of the drill string; incorporate the intended average rotational speed set-point of the drill string into the stick-slip algorithm; receive specifications of the drill string and/or the driver; and incorporate the specifications of the drill string into the stick-slip algorithm.

For each of the different numerical parameters, the control system may be operable to output a different torque command to the driver to thereby cause the driver to output a different amount of torque to rotate the drill string.

The present disclosure also introduces a method comprising commencing operation of a control system for controlling a driver of a drill string, wherein the control system comprises a processor and a memory storing a computer program code, wherein the computer program code comprises a stick-slip algorithm, and wherein the operating control system: (A) receives a plurality of different numerical parameters; and (B) for each of the different numerical parameters: (1) incorporates the numerical parameter into the stick-slip algorithm; and (2) executes the stick-slip algorithm to determine a control command that causes the driver to rotate the drill string to perform drilling operations while reducing rotational waves travelling along the drill string.

The operating control system may also: receive torque measurements indicative of torque at a corresponding portion of the drill string; determine an amplitude of the rotational waves travelling along the drill string based on the torque measurements for each of the different numerical parameters; and determine optimal ones of the different numerical parameters based on the determined amplitudes of the rotational waves, wherein the optimal ones of the different numerical parameters are associated with the lowest of the determined amplitudes of the rotational waves.

The operating control system may: receive rotational speed measurements indicative of rotational speed of a corresponding portion of the drill string; determine an amplitude of the rotational waves travelling along the drill string based on the rotational speed measurements for each of the different numerical parameters; and determine optimal ones of the different numerical parameters based on the determined amplitudes of the rotational waves, wherein the optimal ones of the different numerical parameters are associated with the lowest of the determined amplitudes of the rotational waves.

The different numerical parameters may comprise at least one of a speed integral constant, a speed proportionality constant, and a torque proportionality constant.

Before executing the stick-slip algorithm, the operating control system may: receive an intended average rotational speed set-point of the drill string; incorporate the intended average rotational speed set-point of the drill string into the stick-slip algorithm; receive specifications of the drill string and/or the driver; and incorporate the specifications into the stick-slip algorithm.

For each of the different numerical parameters, the operating control system may output a different torque command to the driver thereby causing the driver to output a different amount of torque to rotate the drill string.

The present disclosure also introduces a method comprising commencing operation of a processing device to run a computer simulation of a drill string being rotated by a driver to drill a wellbore, wherein rotation of the driver is controlled by a stick-slip algorithm, and wherein the operating processing device: (A) receives a plurality of different numerical parameters; and (B) for each of the different numerical parameters: (1) incorporates the numerical parameter into the stick-slip algorithm; and (2) executes the stick-slip algorithm to determine a control command that causes the driver to rotate the drill string to perform drilling operations while reducing amplitude of rotational waves travelling along the drill string.

The operating processing device may: determine the amplitude of the rotational waves travelling along the drill string for each of the different numerical parameters; and determine optimal ones of the different numerical parameters based on the determined amplitudes of the rotational waves, wherein the optimal ones of the different numerical parameters are associated with the lowest of the determined amplitudes of the rotational waves.

The different numerical parameters may comprise at least one of a speed integral constant, a speed proportionality constant, and a torque proportionality constant.

Before executing the stick-slip algorithm, the operating processing device may: receive an intended average rotational speed set-point of the drill string; incorporate the intended average rotational speed set-point of the drill string into the stick-slip algorithm; receive specifications of the drill string and/or the driver; and incorporate the specifications into the stick-slip algorithm.

The computer simulation may be or comprise a numerical simulation.

The computer simulation may be or comprise a physics-based analytic model that utilizes constrained optimizations.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a control system operable to control a driver for rotating a drill string, wherein the control system comprises one or more sensors operable to facilitate measurements indicative of one or more characteristics of one or more corresponding portions of the drill string, wherein the control system comprises a processor and a memory storing a computer program code, wherein the computer program code comprises a stick-slip algorithm, and wherein the control system is operable to:

execute the stick-slip algorithm to determine a control command that causes the driver to rotate the drill string to perform drilling operations while reducing rotational waves travelling along the drill string, wherein the stick-slip algorithm:

determines amplitude of the rotational waves travelling along the drill string based on the measurements for each of different numerical parameters; and determines optimal ones of the different numerical parameters based on the determined amplitudes of the rotational waves, wherein the optimal ones of the different numerical parameters are associated with the lowest of the determined amplitudes of the rotational waves.

2. The apparatus of claim 1 wherein:

the one or more sensors comprise a torque sensor operable to facilitate torque measurements indicative of torque at a corresponding portion of the drill string; and wherein the stick-slip algorithm determines amplitude of the rotational waves travelling along the drill string based on the torque measurements for each of the different numerical parameters.

3. The apparatus of claim 2 wherein the torque sensor is a surface torque sensor operable to facilitate torque measurements indicative of torque at an upper end of the drill string.

4. The apparatus of claim 1 wherein:

the one or more sensors comprise a rotational speed sensor operable to facilitate rotational speed measurements indicative of rotational speed of a corresponding portion of the drill string; and wherein the stick-slip algorithm determines amplitude of the rotational waves travelling along the drill string based on the rotational speed measurements for each of the different numerical parameters.

5. The apparatus of claim 4 wherein the rotational speed sensor is a downhole rotational speed sensor operable to facilitate rotational speed measurements indicative of rotational speed at a lower end of the drill string.

6. The apparatus of claim 1 wherein the different numerical parameters comprise at least one of:

a speed integral constant;

a speed proportionality constant; and a torque proportionality constant.

7. The apparatus of claim 1 wherein, before executing the stick-slip algorithm, the control system is further operable to:

receive an intended average rotational speed set-point of the drill string;

incorporate the intended average rotational speed set-point of the drill string into the stick-slip algorithm;

receive specifications of the drill string and/or the driver; and incorporate the specifications of the drill string into the stick-slip algorithm.

8. The apparatus of claim 1 wherein, for each of the different numerical parameters, the control system is further operable to output a different torque command to the driver to thereby cause the driver to output a different amount of torque to rotate the drill string.

9. A method comprising:

commencing operation of a control system for controlling a driver of a drill string, wherein the control system receives measurements indicative of one or more characteristics of one or more corresponding portions of the drill string, wherein the control system comprises a processor and a memory storing a computer program code, wherein the computer program code comprises a stick-slip algorithm, and wherein the operating control system:

executes the stick-slip algorithm to determine a control command that causes the driver to rotate the drill string to perform drilling operations while reducing rotational waves travelling along the drill string, wherein the stick-slip algorithm:

determines amplitude of the rotational waves travelling along the drill string based on the measurements for each of different numerical parameters; and determines optimal ones of the different numerical parameters based on the determined amplitudes of the rotational waves, wherein the optimal ones of the different numerical parameters are associated with the lowest of the determined amplitudes of the rotational waves.

10. The method of claim 9 wherein the operating control system:

receives torque measurements indicative of torque at a corresponding portion of the drill string; and determines an amplitude of the rotational waves travelling along the drill string based on the torque measurements for each of the different numerical parameters.

11. The method of claim 9 wherein the operating control system:

receives rotational speed measurements indicative of rotational speed of a corresponding portion of the drill string; and determines an amplitude of the rotational waves travelling along the drill string based on the rotational speed measurements for each of the different numerical parameters.

12. The method of claim 9 wherein the different numerical parameters comprise at least one of:

a speed integral constant;

a speed proportionality constant; and a torque proportionality constant.

13. The method of claim 9 wherein, before executing the stick-slip algorithm, the operating control system also:

receives an intended average rotational speed set-point of the drill string;

incorporates the intended average rotational speed set-point of the drill string into the stick-slip algorithm;

receives specifications of the drill string and/or the driver; and incorporates the specifications into the stick-slip algorithm.

14. The method of claim 9 wherein, for each of the different numerical parameters, the operating control system also outputs a different torque command to the driver thereby causing the driver to output a different amount of torque to rotate the drill string.

15. A method comprising:

commencing operation of a processing device to run a computer simulation of a drill string being rotated by a driver to drill a wellbore, wherein rotation of the driver is controlled by a stick-slip algorithm, and wherein the operating processing device:

executes the stick-slip algorithm to determine a control command that causes the driver to rotate the drill string to perform drilling operations while reducing amplitude of rotational waves travelling along the drill string, wherein the stick-slip algorithm:

determines the amplitude of the rotational waves travelling along the drill string for each of the different numerical parameters; and determines optimal ones of the different numerical parameters based on the determined amplitudes of the rotational waves, wherein the optimal ones of the different numerical parameters are associated with the lowest of the determined amplitudes of the rotational waves.

16. The method of claim 15 wherein the different numerical parameters comprise at least one of:

a speed integral constant;

a speed proportionality constant; and a torque proportionality constant.

17. The method of claim 15 wherein, before executing the stick-slip algorithm, the operating processing device also:

receives an intended average rotational speed set-point of the drill string;

incorporates the intended average rotational speed set-point of the drill string into the stick-slip algorithm;

receives specifications of the drill string and/or the driver; and incorporates the specifications into the stick-slip algorithm.

18. The method of claim 15 wherein the computer simulation is or comprises a numerical simulation.

19. The method of claim 15 wherein the computer simulation comprises a physics-based analytic model that utilizes constrained optimizations.

* * * * *